US005655446A

United States Patent [19]

Watanabe

[11] Patent Number: 5,655,446

[45] Date of Patent: Aug. 12, 1997

[54] STENCIL PRINTING PLATE HAVING A SOLUBLE RESIN LAYER

[75] Inventor: Hideo Watanabe, Tokyo, Japan

[73] Assignee: Riso Kagaku Corporation, Tokyo, Japan

[21] Appl. No.: 277,221

[22] Filed: Jul. 19, 1994

[30] Foreign Application Priority Data

| | | | |
|---|---|---|---|
| Jul. 20, 1993 | [JP] | Japan | 5-179321 |
| Nov. 15, 1993 | [JP] | Japan | 5-284931 |

[51] Int. Cl.[6] ..... B41N 1/24

[52] U.S. Cl. ..... 101/128.21; 101/401.1; 428/195

[58] Field of Search ..... 101/114, 127, 101/127.1, 128.21, 128.4, 129, 401.1; 427/143, 273; 428/195

[56] References Cited

U.S. PATENT DOCUMENTS

| | | | |
|---|---|---|---|
| 628,315 | 7/1899 | Haberstroh | 101/128.21 |
| 1,606,217 | 11/1926 | Gestetner | 101/128.21 |
| 2,069,576 | 2/1937 | Cohen | 358/297 |
| 3,209,686 | 10/1965 | Arthurs | 101/368 |
| 3,527,163 | 9/1970 | Bean | 101/127 |
| 3,715,267 | 2/1973 | Kubo et al. | 101/128.21 |
| 4,268,576 | 5/1981 | Montmarquet, Jr. | 101/128.21 |
| 4,550,660 | 11/1985 | Sato et al. | 101/128.21 |

FOREIGN PATENT DOCUMENTS

| | | | |
|---|---|---|---|
| 2206704 | 5/1974 | France . | |
| 456101 | 2/1928 | Germany . | |
| 115898 | 7/1984 | Japan | 101/128.4 |
| 12387 | 1/1986 | Japan | 101/128.4 |
| 12395 | 1/1986 | Japan | 101/128.21 |
| 21596 | 1/1987 | Japan | 101/128.4 |
| 94247 | 4/1988 | Japan | 101/128.21 |
| 4-173294 | 6/1992 | Japan . | |
| 357094 | 12/1992 | Japan | 101/128.4 |
| 125237 | 4/1928 | Switzerland . | |
| 558605 | 1/1944 | United Kingdom . | |
| 2209018 | 4/1989 | United Kingdom . | |

*Primary Examiner*—Stephen R. Funk
*Attorney, Agent, or Firm*—Fay, Sharpe, Beall, Fagan, Minnich & McKee

[57] ABSTRACT

A printing plate and a process for plate-making which requires no particular plate-making apparatus, wherein the plate-making is performed by using a safe aqueous solvent. The printing plate has a resin layer 1 soluble in an aqueous solvent 3 and the process for plate-making comprises the steps of bringing selectively an aqueous solvent (water sign pen 2) like water in contact with the surface of the resin layer 1, and removing partially or wholly the resin layer 1 at the contacted portion by dissolving the resin layer in the aqueous solvent to form an engraved or perforated portion 5. The stencil printing plate has the resin layer adhered to a porous substrate by an adhesive containing a hydrophobic polymer.

3 Claims, 3 Drawing Sheets

STENCIL PRINTING PLATE HAVING A SOLUBLE RESIN LAYER

BACKGROUND OF THE INVENTION

The present invention relates to a printing plate and a process for plate-making.

Photo-sensitive or heat-sensitive printing plates are known. The photo-sensitive plate is processed for plate-making by selectively irradiating the plate to vary the physical properties of light-irradiated portions and non-light irradiated portions and by taking advantage of the differences in the hydrophilic and lipophilic properties of light polymeric substances, the solubilities of their solvents, electrifying properties of photo-conductive substances and the adhesive strength of the light degradative substances. The heat-sensitive plate is processed by selectively applying heat to the plate to vary the physical properties of the heated and non-heated portions and by taking advantage of the differences in adhesiveness of the heat-sensitive material, the differences between hydrophilic and lipophilic properties, or the differences in perforating property of the heat-sensitive film.

These processes for plate-making, however, require an expensive plate-making apparatus hardly used in any other processes than plate-making, and there was such a problem that the process is complicated and the printing plate cannot simply be made.

Japanese patent application laid-open No. Sho 61-12387 discloses a process for plate-making by dissolving a printing plate having a water-insoluble resin layer with a resin-soluble solvent and Japanese patent application laid-open No. Sho 59-67051 discloses a process for plate-making by dissolving a stencil plate in an acidic solution. However, these processes require their special solutions and had some problems from the stand points of safety and environmental pollution.

As a stencil printing plate, a heat-sensitive stencil plate has conventionally been known which is obtained by superposing a thermoplastic resin film on a porous substrate and adhering to each other. In this heat-sensitive stencil plate, there are some processes for plate-making, for example, (1) a process for plate-making by using a heat-generating device of a flash lamp, infrared lamp or others, superposing a hand-written manuscript or preliminarily prepared manuscript on a heat-sensitive plate, and melting and perforating a thermoplastic resin film by the generated heat from the device described above, (2) a process for plate-making by using a thermal head for generating a dotted heat corresponding to a letter image information converted into an electric signal, bringing a heat-sensitive stencil plate in contact with the thermal head, and melting and perforating the thermoplastic resin film.

However, since the processes for plate-making described above require a series of complicated processes for bringing a light-absorbed and heat-generated manuscript or thermal head in contact with a heat-sensitive stencil plate, conveying the heat to the thermoplastic resin film in the heat-sensitive stencil plate to melt the thermoplastic resin film, and subsequently perforate the thermoplastic resin film, there were some problems, for example, (1) a perforation failure is produced due to the incomplete contact between a thermoplastic resin film and a manuscript or thermal head for absorbing the heat; (2) an adhesion failure is produced due to the nonuniformity in contacting pressure of the thermal head, or shrinkage is produced in the heat-sensitive stencil plate; (3) a transfer failure of the heat-sensitive stencil plate occurs due to the melted material of the thermoplastic resin being adhered to the thermal head; (4) a printing failure is produced since the melted material is left in the perforated portion and the passage of the ink is prevented; and others.

BRIEF SUMMARY OF THE INVENTION

In order to solve the problems described above, it is one object of the present invention to provide a printing plate and a process for plate-making using the same requiring no particular plate-making apparatus and convenient plate-making using a highly safe aqueous solution.

It is another object of the present invention to provide a stencil printing plate which is free from any perforation failure and any shrinkage generation thereof at a time of plate-making, and any transfer failure and any printing failure in printing.

The present invention involves the following aspects.

(1) A printing plate having a resin layer soluble in an aqueous solvent.

(2) A process for plate-making using a printing plate, which comprises the steps of providing a printing plate having a resin layer soluble in an aqueous solvent; bringing an optical portion of said resin layer in contact with the aqueous solvent to dissolve the portion; and removing or transferring partially or wholly the dissolved portion of the resin layer.

(3) A process for plate-making according to the item (2), wherein the resin layer and a supply means of the aqueous solvent are in the state of non-contact with each other.

(4) A stencil printing plate in which a resin layer and a porous substrate are adhered to each other with an adhesive, wherein the resin layer is composed of water-soluble resin and the adhesive is composed of a hydrophobic polymer compound.

(5) A stencil printing plate according to the item (4), wherein the solubility parameter of the hydrophobic polymer compound is 10 or less and the hydrophobic polymer compound dissolves and/or swells depending upon an ink to be used in printing.

(6) A stencil printing plate according to the item (4), wherein the adhered amounts of the adhesive is in the range of 0.1–50 g/m$^2$.

Figure 1A:
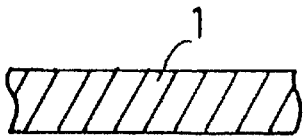
FIG. 1A is an explanatory view showing a printing plate in Example 1.

A printing plate according to the present invention may also be composed of only a resin layer such as a water-soluble resin film which can be obtained by making a film of the water-soluble resin, but the printing plate is preferably composed of a resin layer and a substrate in order to secure its strength. As for a process for forming a resin layer on the substrate, there are exemplified a process by adhering a water-soluble resin film to a substrate or a process by coating the water-soluble resin solution dissolved or dispersed into water or an aqueous solvent on the substrate and drying the coated substrate.

The resin layer used in the present invention contains as a main component a material brought into contact with an aqueous solvent to be dissolved therein, such as a water-soluble resin. As for a water-soluble resin, a resin soluble in water or a water-miscible organic solvent can be used, such as polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, polyacrylamide, starch, dextrin, alginic acid, ascorbic acid, water-soluble urethane and others. These resins may be used independently, or mixed with each other.

The resin layers may contain pigments fillers, binders, curing agents and other, if necessary.

The thickness of the resin layer is preferably in the range of 0.1–1000 μm, and more preferably in the range of 1–500 μm. When the thickness is less than 0.1 μm, the strength of the stencil paper becomes insufficient, and when the thickness exceeds 500 μm, a large amount of the aqueous solvent for dissolving the resin layer becomes necessary, resulting in often giving an insufficient dissolution.

The aqueous solvent to be used in the present invention contains water as a main component, and it is preferably mixed with a water-miscible organic solvent to improve its drying property and wettability prior to use, such as methyl alcohol, ethyl alcohol, isopropyl alcohol, n-propyl alcohol, ethylene glycol, diethylene glycol, propylene glycol, glycerine, acetone, methylethyl ketone, tetrahydrofuran, 1,4-dioxane, formic acid, acetic acid, propionic acid, formaldehyde, acetaldehyde, methylamine, ethylene diamine, pyridine and other. From the stand point of the solubilities of water-soluble resins, the content of these organic solvents is preferably 50 wt. % or less to water and, more preferably, 30 wt. % or less. The aqueous solvent can contain dyestuffs, pigments, fillers, binders, hardeners, antiseptics, swelling agents and others, if necessary.

The printing plates of the present invention can be processed for plate-making as follows:

First of all, an aqueous solvent is brought into contact with selectively the surface of a water-soluble resin layer corresponding to a letter image portion by means of a device such as a syringe, injector, brush, stamp or others, a writing tool such as a brush containing a black ink, fountain pen, water ball pen, water sign pen or others, and an instrument such as an ink jet printer or others. After the water-soluble resin layer is partially or wholly dissolved with an aqueous solvent, the dissolved solution is removed by wiping the surface of the resin layer. In the case that a substrate of the printing plate is a porous substrate, a solution dissolving the resin is absorbed into the porous substrate, and therefore, such a removing step may be omitted. There is no particular limitation of any mean for bringing the aqueous solvent in contact with the resin layer. However, non-contact means such as injection, ink jet printer and the like are preferable, since the plate is not influenced by these means.

When the water-soluble resin layer is brought in contact with the aqueous solvent, the resin components in the resulting contact portion dissolve to form a solution until it is saturated in solubility. Accordingly, since the dissolved amount of the water-soluble resin in the contact portion can be varied, various plates for plate-making can be prepared by appropriately controlling both the solubility of the water-soluble resin layer and the amount of the aqueous solvent to be brought in contact with the water-soluble resin.

For instance, after bringing selectively the water-soluble resin layer in contact with the aqueous solvent to dissolve partially the water-soluble resin layer therein, concave portions are formed in the resin layer by removing the solution in the region thereof. An intaglio printing can be carried out by holding a printing ink in the concave portions and transcripting the ink on the matter to be printed.

In the case of carrying out an off-set printing, printing is carried out by bringing selectively a water-soluble resin layer portion corresponding to either an image or non-image portion, in contact with an aqueous solvent to dissolve the resin layer portion, and then by attaching a water repellent ink to the region excluding the solution.

In the case of carrying out a relief printing, the printing is made by bringing selectively a water-soluble resin layer portion corresponding to the region excluding the image portion in contact with an aqueous solvent to dissolve the resin layer portion, and by removing the solution and attaching the printing ink to the formed convex portion.

In the case of carrying out a stencil printing, a water-soluble resin layer portion corresponding to the region where an image is presented is brought in contact with an aqueous solvent. The required amount of the aqueous solvent is a sufficient amount so that the water-soluble resin layer in the image region may all be dissolved and perforated. The stencil printing is carried out by removing through a means for wiping a resin-dissolved solution and then by supplying a printing ink to the perforated portions of the resin layer.

As a printing ink used in the present invention, an oil ink used in a conventional printing, an oil in water (w/o) type emulsion ink and others may be used. In the case of using a w/o emulsion ink, when a water component in the w/o emulsion ink is rich, the printing paper is swollen, resulting in lowering the paper strength. Therefore, it is preferable to set the mixing ratio of water at a value of 50 wt. % or less.

A stencil printing plate according to the present invention has an adhesive containing a hydrophobic polymer compound between a water-soluble resin layer and a porous substrate. From this constitution, once an aqueous solvent is brought in contact with the resin layer, the aqueous solvent solves the resin component in a contact portion thereof up to the saturation in solubility and subsequently, the resulting solution is absorbed into a porous substrate. Therefore, the perforation is improved in the resin layer portion in contact with the aqueous solvent. In the case that any adhesive including hydrophobic polymer compounds are not existent between a resin layer and a porous substrate, an aqueous solvent in contact with the resin layer is liable to be absorbed into the porous substrate before it does not fully dissolve the resin component in the contact portion. Accordingly, the perforation in the resin layer becomes insufficient.

Since at the time of plate-making the solution which dissolves the resin component permeates into the porous substrate, the dissolved component is retained in the perforated portion not to obstruct the perforated pores. The perforating properties of the resin layer can be adjusted by controlling the dissolution rate of the resin layer to the solvent and the viscosity of the dissolved solution. Incidentally, the adhesive referred to in the invention means such a material as not always requires any adhesive property so long as it shows a temporal adhesiveness required for adhering a resin layer.

The solubility parameter (which will be designated as a SP value thereafter) of a hydrophobic polymer compound used in the above-mentioned adhesive is preferably 10 or less and more preferably 9.5–7.0. If the SP values of the hydrophobic polymer compound exceed 10, the hydrophobic polymer compound cannot easily be dissolved and/or swollen due to the oil components contained in the printing ink and the permeability of the ink is often lowered, since the SP values of nonpolar solvents and oils such as high boiling point solvents, machine oils and others contained in the ink as an oil component are usually 10 or less. Incidentally, the SP values referred to herein indicate a square root of a coagulating energy density of a substance. It is used as an indication of a polarity of the substance. In general, a polymer material shows a good solubility in a solvent having the SP value close to that of the polymer material.

As for a hydrophobic polymer compound having a SP value of 10 or less, for example, styrene resin (SP value 9.0), acrylic resin (SP value 9.3), polyethylene (SP value 7.9), polybutadiene (SP value 8.4), natural rubber (SP value 8.2), styrene-butadiene copolymer (SP value 8.5), ethylene-polyvinyl acetate copolymer (SP value (9.0) and others are exemplified. These polymer compounds may be used as a single compound, or an admixture of two or more compounds.

An adhered amount of a hydrophobic polymer compound as an adhesive is preferably in the range of 0.1–50 g/m$^2$ and more preferably in the range of 0.5–30 g/m$^2$. When the adhered amount thereof is less than 0.1 g/m$^2$, the adhered strength becomes insufficient. When it exceeds 50 g/m$^2$, it takes time to make the hydrophobic polymer compound dissolved and/or swollen by the oil component in the ink, resulting in lowering the permeability of the ink.

As a process for adhering a resin layer soluble in an aqueous solvent and a porous substrate with each other, the following will be exemplified. For example, (1) a process for coating the solution of a hydrophobic polymer compound dissolved or dispersed in a solvent on a porous substrate, drying the porous substrate, and then adhering a resin layer soluble in an aqueous solvent to the porous substrate; (2) a process for impregnating a porous substrate with the solution of a hydrophobic polymer compound dissolved or dispersed in a solvent, drying the porous substrate and then adhering a resin layer to the porous substrate; (3) a process for coating the solution of a hydrophobic polymer compound dissolved or dispersed in a solvent on a resin layer, drying the porous substrate and then adhering the porous substrate to the resin layer.

As for a resin layer soluble in an aqueous solvent, a film prepared in advance can be used. The film may be prepared by dissolving the resin in a solvent, coating the resulting solution on a peeling sheet, drying the sheet, and peeling off the sheet, if necessary. It may also be used to coat the resulting solution directly on an adhesive layer on the substrate, and drying the substrate. Incidentally, the above-mentioned peeling sheet may be peeled off after the resin layer is adhered to the porous substrate.

As a resin for the resin layer soluble in an aqueous solvent, polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, or polyacrylamide are exemplified. The aqueous solvent refer to water or water-miscible organic solvent. These resins may be used as a single compound or mixture thereof. Also, they may contain dyestuffs, pigments, fillers, binders, curing agents and others.

The thickness of the resin layer is normally in the range of 0.1–100 μm, and preferably in the range of 1–50 μm.

As for a porous substrate used in the invention, a thin paper, a screen cloth, or a non-woven fabric of natural fibers such as Manila hemp, pulp, Kozo (paper mulberry), Mitsumata (Edgeworthia papyriferd), Japanese paper or others, synthetic fibers such as those of polyester, polyamide, polyvinyl acetate, polyvinyl alcohol, metal fibers, glass fibers, and a mixture thereof are exemplified. The basis weight of these porous substrate are preferably in the range of 1–20 g/m$^2$, and more preferably in the range of 5–15 g/m$^2$. When the basis weight is less than 1 g/m$^2$, the resulting strength is weakened as a substrate. When it exceeds 20 g/m$^2$, the permeability of the ink often becomes bad at a time of printing. The thickness of the porous substrate is preferably in the range of 5–100 μm and more preferably on the range of 10–15 μm. When the thickness is less than 5 μm, the resulting strength is weakened as a substrate, and when it exceeds 100 μm, the permeability of the ink often becomes bad at a time of printing.

As an aqueous solvent which dissolves the resin layer, water, solvents of alcohol type, ketone type, ester type, ether type, aldehyde type, carboxylic acid type, amine type, low molecular heterocyclic compounds, and the like are usable. Specifically, water, methyl alcohol, ethyl alcohol, isopropyl alcohol, n-propyl alcohol, butyl alcohol, ethylene glycol, diethylene glycol, propylene glycol, glycerine, acetone, methyl ethyl ketone, ethyl acetate, ethyl ether, tetrahydrofuran, 1,4-dioxane, formic, acid, acetic acid, propionic acid, formaldehyde, acetaldehyde, methylamine, ethylene diamine, dimethyl formamide, pyridine, ethylene oxides and others are exemplified. These compounds may also be used as a single compound or in admixture thereof. These solvents can contain dyestuffs, pigments, fillers, binders, curing agents, antiseptic, swelling agents, surfactants, pH controllers and others, if necessary.

The plate-making of the stencil paper of the present invention may be carried out by bringing a means, such as a brush pen impregnated with an aqueous solvent, in contact with a resin layer directly, but it is preferable to do plate-making by supplying the aqueous solvent in a non-contact condition by a releasing device of the aqueous solvent to the resin layer so as to perforate it. As for a releasing means, such a releasing device provided with a nozzle, slit, injector, porous material (or film) or the like connected to a feed pump, piezo-electric element or heating element so as to release the solvent intermittently or continuously, in other words, dottingly or in a line form in accordance with letter image signal, is exemplified. According to such a method, a plate-making can be done in a non-contact condition of a stencil plate with a plate-making apparatus, and therefore, a shrinkage or deformation of the plate can be prevented at a time of plate-making. In addition, different from a conventional heat-sensitive plate, as the melted resin material at a time of plate-making is not left in the perforated portion, printed materials of a high brilliance can be obtained. Further, there is no need of providing a peeling property, antifriction or mechanical strength as required in the conventional heat-sensitive stencil plate.

The stencil printing plate of the present invention can be used in a normal stencil printing. For example, an ink is fed on the plate after plate-making, a printing paper is attached on the other side than the side of feeding ink of the plate, and then the ink is passed through the perforated portion by means of press or squeegee to transfer the ink to the printing paper, resulting in giving a printed matter. As a printing ink, an oil ink used in a conventional printing, an oil in water drop (w/o) type emulsion ink and others are used. As the oil components in these inks, liquids, such as high boiling point solvents, high boiling point oils, machine oils, surfactants and others, are contained for the fluidity, permeability, stability and others. Since these components are dissolved and/or swollen by being brought in contact with a hydrophobic polymer compound used as an adhesive component, the permeation of the ink becomes easy.

Figure 5:
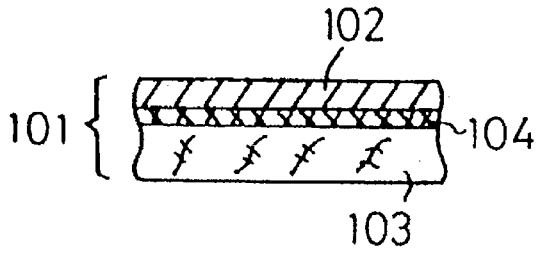
FIG. 5 is a sectional view showing a stencil printing plate as an embodiment of the present invention.

FIG. 5 is a sectional view showing a stencil plate as an embodiment of a stencil printing plate of the invention. In the drawing, a stencil plate 101 is constituted so that a porous substrate 103 and a resin layer 102 soluble in an aqueous solvent may be adhered to each other by an adhesive 104.

Figure 6:
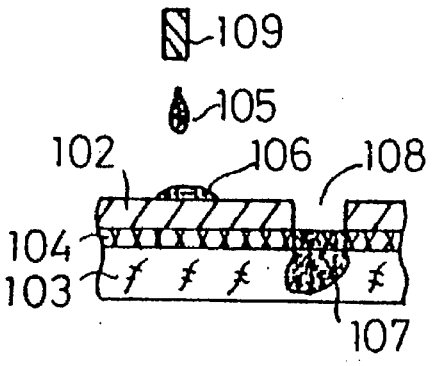
FIG. 6 is an explanatory view showing a perforation of a stencil printing plate as an embodiment of the present invention.

FIG. 6 is an explanatory view showing the perforations in a stencil plate as an embodiment of the invention. In the drawing, an aqueous solvent 105 is released from a releasing means 109 as to be brought in contact with the surface of a resin layer 102 soluble in the aqueous solvent. The contacted aqueous solvent 106 dissolves the resin layer in the contact portion to give a resin solution, which permeates into a porous substrate 107 through the interstices in the layer of the adhesive 104, resulting in perforating the resin layer in the contact portion. A reference number 107 shows a resin solution permeated into the porous substrate, and 108 shows a perforated portion of the resin layer.

Figure 7:
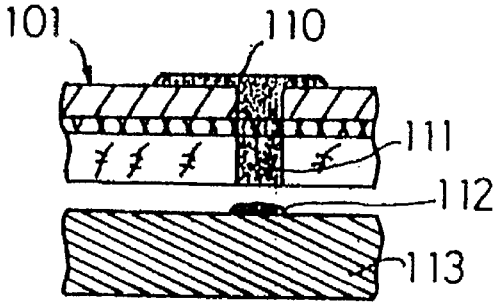
FIG. 7 is an explanatory view showing a printing of a stencil printing plate as an embodiment of the present invention.

FIG. 7 is an explanatory view showing a printing by means of a stencil plate as an embodiment of the present invention. In the drawing, when an ink 110 is fed on the resin layer soluble in the aqueous solvent of the stencil plate 101 and squeezed, the ink 110 is transferred to a printing paper 113 through the porous substrate from the perforated portion. A reference number 111 shows an ink passing through the perforated portion, and 112 shows an ink transferred to the printing paper.

DESCRIPTION OF THE PREFERRED EMBODIMENTS

The present invention will be explained in detail by the following examples. It should be understood, however, that these examples do not limit the scope of the present invention. Incidentally, each part in the following examples will be represented by weight.

EXAMPLE 1

(1) Plate-making of Printing Plate

Figure 1B:
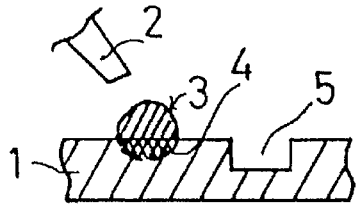
FIG. 1B is an explanatory view showing an engraved plate after plate-making in Example 1.

FIG. 1A is a crosssectional view of a printing plate 1 used in this example and FIG. 1B is an explanatory view of plate-making of the printing plate. In these figures, letter images were drawn by hand with a water sign pen 2 on a printing plate 1 composing of polyvinyl alcohol film of 40 μm in thickness. The attached ink 3 and the dissolved portion 4 were wiped off before they were dried. Then, the letter image portion on this film was traced by the similar sign pen and the remaining ink was wiped off before it is dried out. This operation was repeated five times to form the concave portion 5 of 20 μm in depth corresponding to the letter image on the plate.

(2) Intaglio Printing

An oil ink was placed on the above printing plate after plate-making, and the ink was supplied to the letter image portion of a concave portion by squeezing with a blade. At the same time, the ink in all the places except the concave portion was removed. After a printing paper was overlapped on this plate and the printing paper was peeled off, the inverted image was printed on the printing paper.

EXAMPLE 2

(1) Preparation of a Printing Plate and a Plate-Making

Figure 2A:
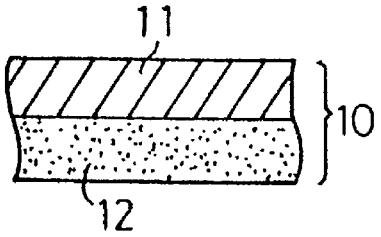
FIG. 2A is an explanatory view showing a printing plate in Example 2.
Figure 2B:
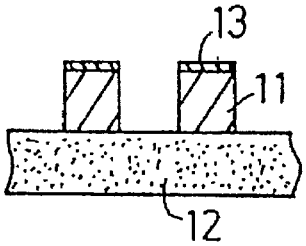
FIG. 2B is an explanatory view showing an engraved plate after plate-making in Example 2.

FIG. 2A is an explanatory view showing a printing plate in this example, and FIG. 2B is an explanatory view of an engraved plate after plate-making. A printing plate 10 was prepared by coating an aqueous polyvinyl acetal solution with a wire bar on a peeling sheet 12 which had been treated with a silicone resin, and dried off to form a water-soluble resin layer 11 of 300 μm in thickness. A polyvinyl chloride tape 13 was adhered according to a picture image to the surface of the water-soluble resin layer 11 of the printing plate 10, and then, washed with water to dissolve the resin layer 11 to form convex portions corresponding to the picture image, to obtain a plate-making for relief printing.

(2) Relief Printing

After an oil ink was adhered by a roller to the convex portion (the tape portion 13) of the plate-making, a printing paper was overlapped on this plate-making and pressed. When the printing papaer was peeled off, a picture image was printed on the printing paper. The plate 13 may be removed before printing.

EXAMPLE 3

(1) Preparation of a Printing Plate and Its Plate-Making

Figure 3A:
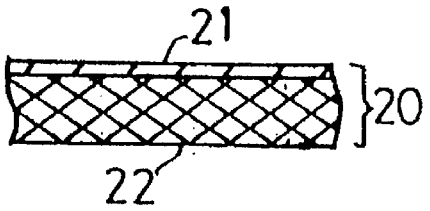
FIG. 3A is an explanatory view showing a printing plate in Example 3.
Figure 3B:
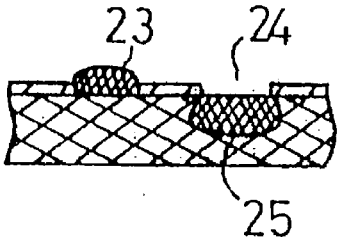
FIG. 3B is an explanatory view showing an engraved plate after plate-making in Example 3.

FIG. 3A is an explanatory view showing a printing plate in this example, and FIG. 3B is an explanatory view of an engraved plate after plate-making. A water-soluble resin solution consisting of the following composition was coated by a roll coater on a porous substrate 22 consisting of polyester fibers, and having a sieve opening of 200 mesh and dried out to form a water-soluble resin layer 21 of 3 μm in thickness, to obtain a printing plate 20.

| | |
|---|---|
| Polyvinyl pyrolidone | 20 wt. parts |
| Water-soluble polyurethane | 5 wt. parts |
| Methyl alcohol | 15 wt. parts |
| Water | 60 wt. parts |

Letters and images prepared by means of a personal computer were printed by an ink jet printer using an aqueous ink on the surface of the water-soluble resin layer 21 of the printing plate. Then, the resin layer 21 in the letter portion is dissolved and permeated into the porous substrate 22 and the letter portion 24 in the water-soluble resin layer 21 was perforated. Symbol 23 shows an aqueous solution of the water-soluble resin, and 25 shows a portion of the porous substrate impregnated with the dissolved solution.

(2) Stencil Printing

When a printing plate after plate-making was mounted on a stencil printing device (RISO KAGAKU CORPORATION product, PRINTGOKKO PG-10) to carry out a stencil printing, the letter image printed by the ink jet printer described above could be obtained.

EXAMPLE 4

(1) Preparation of a Printing Plate and Its Plate-Making

Figure 4A:
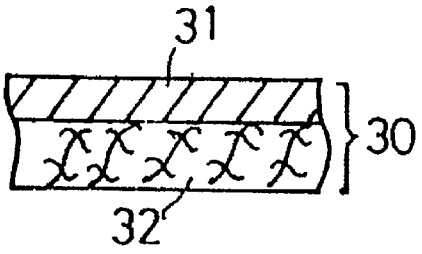
FIG. 4A is an explanatory view showing a printing plate in Example 4.
Figure 4B:
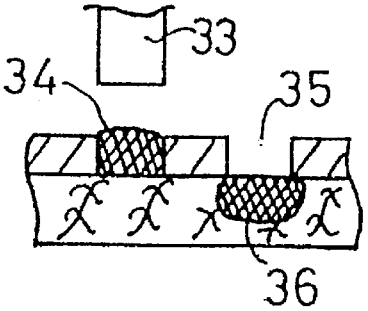
FIG. 4B is an explanatory view showing an engraved plate after plate-making in Example 4.

As shown in FIG. 4A, a Japanese paper 32 having a basis weight of 10 g/m$^2$ and a polyvinyl ether film 37 of 20 μm in thickness were processed through a heat roller at 120° C. to be adhered with each other, to give a printing plate 30. A stamp 33 for a new year greeting postcard was impregnated with an aqueous solution consisting of the following composition and pushed on the surface of the water-soluble resin layer 31 of the printing plate. The resin layer corresponding to the image portion of the stamp was dissolved and permeated into the Japanese paper to perforate the stamp image as shown in FIG. 4B. In this figure, symbol 34 shows the dissolved solution of the resin, 36 shows a portion of Japanese paper impregnated with the solution, and 35 shows the perforated portion of the resin layer.

| | |
|---|---|
| Isopropyl alcohol | 20 wt. parts |
| Ethylene glycol | 5 wt. parts |
| Water | 75 wt. parts |

(2) Stencil Printing

The printing plate after plate-making was mounted on a stencil printer RISO KAGAKU CORPORATION product, RISOGRAPH RC115, Registered Trademark) and 2000 sheets of the printing papers were continuously printed. Good printed matters were obtained from the first sheet to the last sheet of 2000 sheets.

EXAMPLE 5

A stencil printing plate shown in FIG. 5 is prepared as follows.

A resin solution consisting of polyethylene oxide (15 parts), isopropyl alcohol (15 parts) and water (70 parts) was coated by a reverse coater on a silicon treated paper and the coated paper was dried to form a resin layer of 3 μm in thickness.

A polyester fiber cloth having a sieve opening of 300 mesh as a substrate was immersed in an adhesive solution consisting of acrylic resin (SP value 9.3, 20 parts), isocyanate (5 parts), toluene (45 parts) and ethyl acetate (30 parts), and then, drawn up and dried off. After drying, the adhered amount of the adhesive was 5 g/m$^2$. The above-mentioned resin layer was superposed on the polyester fiber cloth, left in a constant temperature chamber at 40° C. over night, and then, a paper for separating on the resin layer was peeled off to give a stencil printing plate.

An aqueous solvent consisting of isopropyl alcohol (20 parts), ethylene glycol (10 parts ) and water (70 parts) was released in a letter shape from a releasing means provided with a nozzle of 8 dots/mm and a piezo-electric element on the surface of the resin layer of the stencil plate thus obtained and the resin component (polyethylene oxide) of the releasing portion was dissolved, resulting in perforating the resin portion.

A black oil ink consisting of carbon black (10 parts), alkyd resin (20 parts), resin modified phenolic resin (10 parts) and Niseki #4 solvent (60 parts) was placed on the stencil plate after plate-making, followed by superposing a printing paper on the other side of the plate, and squeezing the ink by a blade to the plate. As a result, brilliant black letters corresponding to the perforated portions were printed on the printing paper.

EXAMPLE 6

Example 5 was repeated except that the solution consisting of ethylene-vinyl acetate copolymer (SP value 9.0, 20 parts), toluene (40 parts) and methyl ethyl ketone (40 parts) was used as an adhesive solution and the adhered amount of the adhesive was made to 10 g/m$^2$.

The plate-making and printing of the stencil plate thus obained was carried out in similar manner as that of Example 5. As a result, good printed matter was obtained.

EXAMPLE 7

A resin solution consisting of polyvinyl ether (15 parts), methyl alcohol (15 parts) and water (70 parts) was coated by a reverse coater on a polypropylene film of 40 μm in thickness, followed by drying to form a resin layer (3 μm in thickness) soluble in an aqueous solvent.

Next, a pressure sensitive adhesive solution consisting of polybutadiene (SP value 8.4) of 20 parts and toluene (80 parts) was coated by a gravure coater on a polyester fiber cloth having a sieve opening of 300 mesh and dried to adhere a pressure sensitive adhesive of 10 g/m$^2$ thereon.

Subsequently, this pressure sensitive adhesive and the above-mentioned resin layer were superposed to each other and adhered by a pressure roller at 5 kg/cm$^2$, and then the polypropylene film was peeled off from the resin layer to obtain a stencil printing plate 101 as shown in FIG. 5. In the drawing, symbol 102 is a resin layer, 103 is a porous substrate, and 104 is an adhesive.

An aqueous solvent consisting of isopropyl alcohol (15 parts), glycerine (15 parts) and water (80 parts) was released in a letter shape from a solvent releasing means provided with a nozzle of 8 dots/mm and a heating element on the stencil plate obtained in the above and the resin components (polyvinyl ether) in the released portion was dissolved to be perforated.

Then, the oil ink in similar to that in Example 5 was deposited on the stencil plate after plate-making, a printing paper was superposed to it and they are impressed, a brilliant letter image corresponding to the perforated portion was printed on the printing paper.

EXAMPLE 8

A pressure sensitive adhesive solution consisting of stylene-butadiene copolymer (SP value 8.5) of 30 and toluene (70 parts) was coated on the polyvinyl alcohol film 102 of 5 μm in thickness and dried to obtain a pressure sensitive adhesive 104 of 15 g/m$^2$ adhered, thereon as shown in FIG. 5. A Japanese paper 103 having a basis weight of 12 g/m$^2$ was adhered on the adhesive layer 104 by a pressure roller at 5 kg/cm$^2$ to give a stencil plate as shown in FIG. 5.

Following the similar process to that of Example 7, the plate-making was made on the stencil plate thus obtained, followed by subjecting to printing. As a result, good printed matters were obtained.

EXAMPLE 9

A resin solution consisting of polyvinyl acetal (15 parts), isopropyl alcohol (15 parts) and water (70 parts) was coated by a reverse coater on a polypropylene film of 40 μm in thickness and dried to form a resin layer soluble in an aqueous solvent of 3 μm in thickness.

Then, adhesive solution consisting of styrene resin (SP value 9.0) of 20 parts, toluene (40 parts) and methyl ethyl ketone (40 parts) is coated on the resin layer described above by a gravure coater so as to get the adhered amount of 10 $g/m^2$ after drying. A Japanese paper as a porous substrate having a basis weight of 12 $g/m^2$ were adhered to the resin layer through the adhesive, followed by drying to obtain a stencil printing plate.

Following the similar process to that of Example 7, the plate-making was made on the stencil plate thus obtained, followed by subjecting to printing. As a result, good printed matters were obtained.

According to the printing plate and the process for plate-making using the printing plate of the present invention, the plate-making can be made easily and with safety with no particular apparatus.

According to the stencil plate of the invention, perforation can be done in a non-contact condition using an aqueous solvent, and therefore, the perforation failure at a time of plate-making, the generation of shrinkage and the transfer failure can be prevented. Since a hydrophobic polymer compound is used as an adhesive, the perforation of the resin layer by using an aqueous solvent is made sufficiently and brilliantly. Furthermore, a hydrophobic polymer compound is dissolved and/or swollen depending upon the ink components, the permeation of the ink at a time of printing becomes good and brilliant printed matters can be obtained.

What we claim is:

1. A stencil printing plate comprising:

a resin layer; and a porous substrate adhered to the resin layer with an adhesive, said adhesive in direct contact with said resin layer, wherein said resin layer is composed of a water-soluble resin and said adhesive is composed of a hydrophobic polymer compound wherein aqueous solvent contact with the resin layer causes stencil printing plate perforation.

2. A stencil printing plate according to claim 1, wherein a thickness of said adhesive is in the range of 0.1–50 $g/m^2$.

3. A stencil printing plate comprising:

a resin layer; and a porous substrate adhered to the resin layer with an adhesive, wherein said resin layer is composed of a watersoluble resin and said adhesive is composed of hydrophobic polymer compound which is at least one compound selected from the group consisting of styrene resin, acrylic resin, polyethylene, polybutadiene, natural rubber, styrene-butadiene co-polymer and ethylene-vinyl acetate co-polymer; wherein aqueous solvent contact with the resin layer causes stencil printing plate perforation.

* * * * *